United States Patent [19]

Baier

[11] 3,996,942

[45] Dec. 14, 1976

[54] ARRANGEMENT FOR DETERMINING THE MASS OF A STREAM OF TOBACCO, OR OTHER CONSTITUENT MATERIAL OF SMOKERS' PRODUCTS

[75] Inventor: Anton Baier, Hamburg, Germany

[73] Assignee: Hauni-Werke Korber & Co., KG, Hamburg, Germany

[22] Filed: Mar. 21, 1975

[21] Appl. No.: 560,991

[30] Foreign Application Priority Data

Mar. 23, 1974 United Kingdom ..... 13021/70

[52] U.S. Cl. ..... 131/21 R

[51] Int. Cl.[2] ..... A24B 7/14

[58] Field of Search ..... 131/21 R, 21 A, 21 B, 131/21 C, 21 D; 235/183, 151.13; 328/127

[56] References Cited

UNITED STATES PATENTS

| | | | |
|---|---|---|---|
| 3,742,232 | 6/1973 | Koehn | 235/151.3 |
| 3,862,408 | 1/1975 | Bolt | 235/183 |

*Primary Examiner*—G.E. McNeill
*Attorney, Agent, or Firm*—Peter K. Kontler; John Kurucz

[57] ABSTRACT

A machine processes tobacco, filter material or other constituent material of smokers' products, or the like, with a stream of such material moving along a predetermined path. An arrangement for detecting the mass of the material in the stream includes a first circuit operative for generating a first periodic signal having a first frequency, and a second circuit operative for generating a second periodic signal having a second frequency. At least one of the two circuits is comprised of a frequency-determining capacitor structure positioned in proximity to material moving along a predetermined portion of the stream travel path and so disposed as to have a capacitance value dependent upon the mass of material penetrated by electric field lines of the capacitor structure. A signal combining circuit combines the first and second periodic signals to form a resultant periodic signal exhibiting a beat. A measuring device provides an indication of the mass of material penetrated by electric field lines of the capacitor structure by detecting the frequency of the beat.

29 Claims, 4 Drawing Figures

ARRANGEMENT FOR DETERMINING THE MASS OF A STREAM OF TOBACCO, OR OTHER CONSTITUENT MATERIAL OF SMOKERS' PRODUCTS

BACKGROUND OF THE INVENTION

The invention relates to an arrangement for determining the mass of a narrow, more or less enclosed stream of tobacco, filter rod material, or other constituent material of smoker's products, and the like, using a measuring capacitor having electrodes connected to a high-frequency voltage source, with a measuring capacitor constituting at least part of the frequency-determining reactance of a circuit operative for generating a high-frequency periodic signal, preferably a variable-frequency resonant circuit.

A stream of tobacco or other material is to be considered "enclosed", for the purposes of the present description, if conveyed in a certain manner. The enclosing can be, for example, that constituted by provision of a wrapper, such as a wrapper made of paper (cigarette paper) or tobacco strips. However, the enclosing can also be constituted by the provision of boundary walls in a guide conduit for tobacco or other material, such walls being either stationary or travelling with the material.

Capacitive methods for measuring the density of a continuous cigarette rod in a cigarette rod forming machine are known, for example, from U.S. Pat. No. 2,357,860. The electrodes of the measuring capacitor are connected to the terminals of a high-frequency voltage source and are configurated as plates arranged on opposite sides of the continuous cigarette rod. The capacitor constituted by the electrodes, between which the cigarette rod travels, forms part of a high-frequency resonant circuit which, in response to a change of the tobacco mass in the continuous cigarette rod, undergoes detuning, such detuning constituting a direction indication of tobacco mass variation.

However, in actual practice, the prior-art capacitive measuring arrangements produce output signals which are incapable of being reliably processed for the purpose of making a determination of the tobacco density. As a result, the art has turned more and more to nuclear measuring expedients according to which the wrapped continuous cigarette rod is penetrated by beta rays emitted from a radioactive substance, such as strontium-90, with the weakening of the emitted radiation which results from passage of such radiation through the material of the cigarette rod being determined by means of an ionization chamber.

The use of radioactive materials in the foodstuffs industry, to which in a broad sense the tobacco-processing industry belongs, is subject to stringent governmental regulation in all countries. In order to generate highly responsive measuring signals — i.e., signals which change in value in almost immediate response to changes in the irradiated material and thereby accurately indicate mass variations along even a small length of a stream of such material — it is necessary to use an undesirably high radiation power.

Finally, for reasons involving the structure of the nuclear measuring devices, it is very difficult to measure the density of a continuous tobacco rod at a location upstream of where it is wrapped in a cigarette paper, or the like. However, measurement at just such location is particularly important, because it makes possible a correction of for example the mass excess of a stream portion before such portion reaches the wrapping location. Such correction usually involves the removal of excess tobacco or other material from the travelling stream in a controlled manner resulting in a stream of relatively uniform mass in the region of the wrapping location.

From the foregoing it follows that a capacitive measuring method, at least for the generation of signals for determining the short-lasting fluctuations in the mass of the tobacco stream or rod, would be extremely advantageous, if it made possible the generation of usuable signals.

SUMMARY OF THE INVENTION

It is a general object of the invention to provide a novel capacitive measuring arrangement for measuring the density of a narrow tobacco stream or tobacco rod, or of a stream or rod of filter rod material or other constituent material of smoker's products.

The invention involves not only improved circuit concepts for the measuring circuitry but also an improved form for the electrodes of the measuring capacitor structure of the arrangement, since in the prior art both the measuring circuitry and the structure of the measuring capacitor leave much to be desired.

These objects, and other objects and advantages which will become understandable from the description, below, of preferred embodiments, can be achieved, according to one advantageous concept of the invention, by taking the output signal, preferably the output voltage, of a first high-frequency resonant circuit having a first frequency which is a function of detected tobacco mass, and combining such signal with the output signal of a second high-frequency resonant circuit having a fixed second frequency differing from the first frequency by an amount which is small or negligible, compared to the frequencies of the two output signals themselves, to form a resulting periodic signal exhibiting a beat, and then providing an indication of the mass of tobacco by determining the frequency of the beat.

The periodic signal exhibiting the beat is converted into a signal having the frequency of the beat (or a low whole-number fraction or multiple thereof). This frequency is significantly lower than the frequency of the two high-frequency signals which are combined to produce the signal having the beat. For example, the aforementioned first and second signals may have frequencies which are at least approximately one order of magnitude greater than their difference. The frequencies of the high-frequency first and second signals are chosen as high as possible, for example in the range between approximately 100 Megahertz and 500 Megahertz. Concerning the choice of the frequencies of the first and second signals, i.e., the signals generated by the variable-frequency resonant circuit and by the fixed-frequency reference resonant circuit, it can be said that measuring signals of higher frequency, although more difficult to control, produce better measurements.

A measuring circuit detects the value of a characteristic of the beat-exhibiting signal resulting from the superposition of the two high-frequency oscillations. To this end, according to a further concept of the invention, it is the frequency of the beat-exhibiting signal which is monitored, because the frequency of the beat undergoes quite marked changes in response to changes in the frequency of the output voltage of the high-frequency resonant measuring circuit such as result from tobacco mass changes, and these beat frequency changes can be determined relatively easily by means of a ratio rectifier.

The undesired dependence of the final measurement upon the moisture content of the tobacco whose mass is being measured can be to a great degree eliminated, by generating a moisture-content-indicating signal and using it as a control signal for controlling the amplitude of the voltage applied to the ratio rectifier.

According to one advantageous concept of the invention, the capacitor structure employed for measuring the mass of tobacco, filter rod material, or other constitutuent material of smoker's products, and the like, will be particularly well adapted for use with the circuit expedient just described, if it is comprised of electrodes arranged spaced from each other in the direction of travel of the stream or rod of tobacco or other material, with the electrodes at least partially encircling the stream or rod, as considered in a plane normal to the direction of travel of the stream or rod.

With such a capacitor structure, the tobacco stream or rod is not penetrated by electric field lines of a homogeneous portion of an electric field, which is the expedient of the prior art, but instead is penetrated by the electric field lines of a stray field. With such a stray field it is particularly important that the field lines pass into and out of the stream or rod (a rod is considered herein to be a stream having a well-defined form) of tobacco or other material at several locations of the surface of the stream, preferably into the stream, from all sides. According to another concept of the invention, the electrodes of the capacitor structure encircle the tobacco stream or rod completely or else surround the major portion of the circumference of the stream. Since the electric field preferred according to the invention is a stray field, if only two electrodes were used, the field lines would be unsymmetrically distributed. However, a symmetrical distribution of the field lines is very advantageous for a sensitive measurement. A symmetrical field distribution can be achieved, according to a further advantageous concept of the invention, by providing a plurality of encircling electrodes, including a middle electrode maintained at one electric potential and two further electrodes, respectively located upstream and downstream of the middle electrode and maintained at a common electric potential different from that of the middle electrode. Advantageously, the middle electrode is connected to one terminal of a high-frequency voltage source, so that it is periodically "hot", with the further electrodes both being grounded.

In addition to a symmetrical distribution of the electric field lines, it is desirable that they be concentrated in a well-defined region of space. To this end, according to a further advantageous concept of the invention, preferably the middle electrode has the form of a bent wire, whereas the neighboring electrodes have substantial surface area, being for example made from sheet material. An additional advantage of this latter expedient is that the wire-like electrode can be arranged very close to the stream of tobacco or other material, so that measurement errors attributable to variations in the distance between the electrode and the stream encircled by the electrode can be kept to a minimum.

If the measuring capacitor structure is to be used to measure the density of, for example, a continuous wrapped rod of tobacco or filter material, then, in order that the electric field lines be symmetrically distributed and concentrated in a well-defined region of space, the electrodes of the capacitor structure are advantageously so configurated that they very closely encircle the continuous wrapped rod. Basically, the same applies in the event that the stream of tobacco or other material is conveyed between confining walls, for example between the side walls of a guide channel. If necessary for practical reasons involving the construction and/or operation of the rod forming machine, one side, for example the upper surface, of the stream can be left open, i.e., so that the stream is not completely enclosed. The enclosing or encircling of only the major portion of the tobacco stream still suffices for the generation of a satisfactory signal, particularly when the portion of the stream which is not penetrated by stray field lines is anyway destined to be removed, such as is commonly the case with a tobacco stream where the excess tobacco is cut or shaved off the top of the stream.

The mass-indicating output signal furnished by the capacitive measuring arrangement can be utilized in a variety of ways. Since the mass-indicating signal requires only a short time, for example fraction of a millisecond, to assume a value correctly corresponding to the mass of the material, such signal is well suited for application to an indicating arrangement operative for indicating the density of relatively small or relatively large sections of the stream. For example, it is possible to generate mass-indicating signals whose values correspond accurately to well-defined limited portions of the stream of material corresponding to fractions of individual rod-shaped units (cigarettes, cigarillos, cigars, filter rods, etc.) subsequently formed by cutting the continuous rod of material into segments. Certain well-defined limited portions of the stream — for example those portions destined to become the end portions of the individual rod-shaped units later formed by severing the continuous rod of material — may be of particular interest.

The mass-indicating signal can also be applied to a classifier device operative for determining into which of several preselected ranges the value of the mass-indicating signal falls and operative for keeping a record of the number of product units whose mass falls into each range, so as to provide an indication of the distribution of the mass characteristics of the products being formed, for quality-control purposes.

The mass-indicating signal can also be applied to a comparator or subtractor which also receives a signal indicative of the desired mass value and which is operative for generating a difference signal indicative of the discrepancy between the desired and detected values of the mass. This discrepancy-indicating signal can be utilized in various ways. The discrepancy-indicating signal can be employed as a control signal controlling the operation of a reject-ejecting mechanism operative for ejecting finished rod-shaped units whose characteristics fall below acceptable standards. Such defective units may for example be cigarettes containing an insufficient total mass of tobacco or cigarettes having too little tobacco in certain portions, particularly in the head portions. The indication of an unacceptable mass of material in a rod-shaped unit may also involve insufficient masses of filter material or other constituent material in a filter rod unit, for example due to an improper ratio or softener to acetate in the stream of filter rod material. Additionally, the indication of an unacceptable mass of material may correspond to the presence in a rod-shaped unit of a region having an excessive density, for example having the form of a dense vein of material in a portion of the rod-shaped unit, such as could for any of various reasons cause annoyance to the smoker of the finished product.

The above-mentioned discrepancy-indicating signal can also be applied to a mechanism which effects a change in the mass of the section of the stream corresponding to the discrepancy-indicating signal, i.e., such signal can be applied to a mechanism which effects a corrective action. This mechanism can be a controllable cutting knife movable closer to and farther from the stream, under the control of the discrepancy-indicating signal, to shave off from the stream a greater or lesser amount of material, to thereby change the mass of tobacco in the stream to a value reducing the discrepancy.

The measuring arrangement disclosed herein is particularly suited for generating a mass-indicating signal which changes rapidly in response to rapid variations in the density of the material being measured. A very accurate determination of the absolute density value of a stream of tobacco can be made using the earlier-mentioned nuclear measuring device of the type wherein beta rays are emitted from a radioactive material and passed through the stream of material, with the weakening of the emitted radiation attributable to passage through the stream of material being determined by means of an ionization chamber. A measuring device of this type, operative for determining the absolute value of the tobacco density, for a variety of reasons happens to exhibit a long time constant when performing a measuring operation. However, the somewhat sluggishly responding nuclear measuring device is well suited for providing a compensating action in a control arrangement of the type described above, i.e., in a control arrangement responsive to the discrepancy-indicating signal generated using the novel capacitive measuring circuitry and novel capacitor structure of the invention.

Whereas the last-mentioned discrepancy-indicating signal can be utilized to effect rapid changes in the position of, for example, the adjustable-position stream-shave-off knife, in order to control the feed of tobacco, the signal provided by the nuclear measuring device can be utilized for long-term maintenance of the desired density or mass value. For example, the mass-indicating signal generated by the nuclear measuring device can be combined with a desired-mass-indicating signal to form a supplemental discrepacy-indicating signal which is applied to the positioning motor for the shave-off knive. In this wav, over the long term, the discrepancy-indicating signal provided by the beat-frequency capacitive measuring circuit can be kept at the null (zero-discrepancy) value, and need not be maintained for prolonged periods at substantial non-zero-discrepancy values, since prolonged periods of non-zero discrepancy are dealt with by the adjustable-position shave-off knife under the control of the discrepancy-indicating signal furnished by the nuclear measuring arrangement. One advantage of the expedient just mentioned is that drift in the capacitive measuring circiutry will not lead to persisting errors in the mass-indicating signal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTIN OF THE PREFERRED EMBODIMENTS

Figure 1:
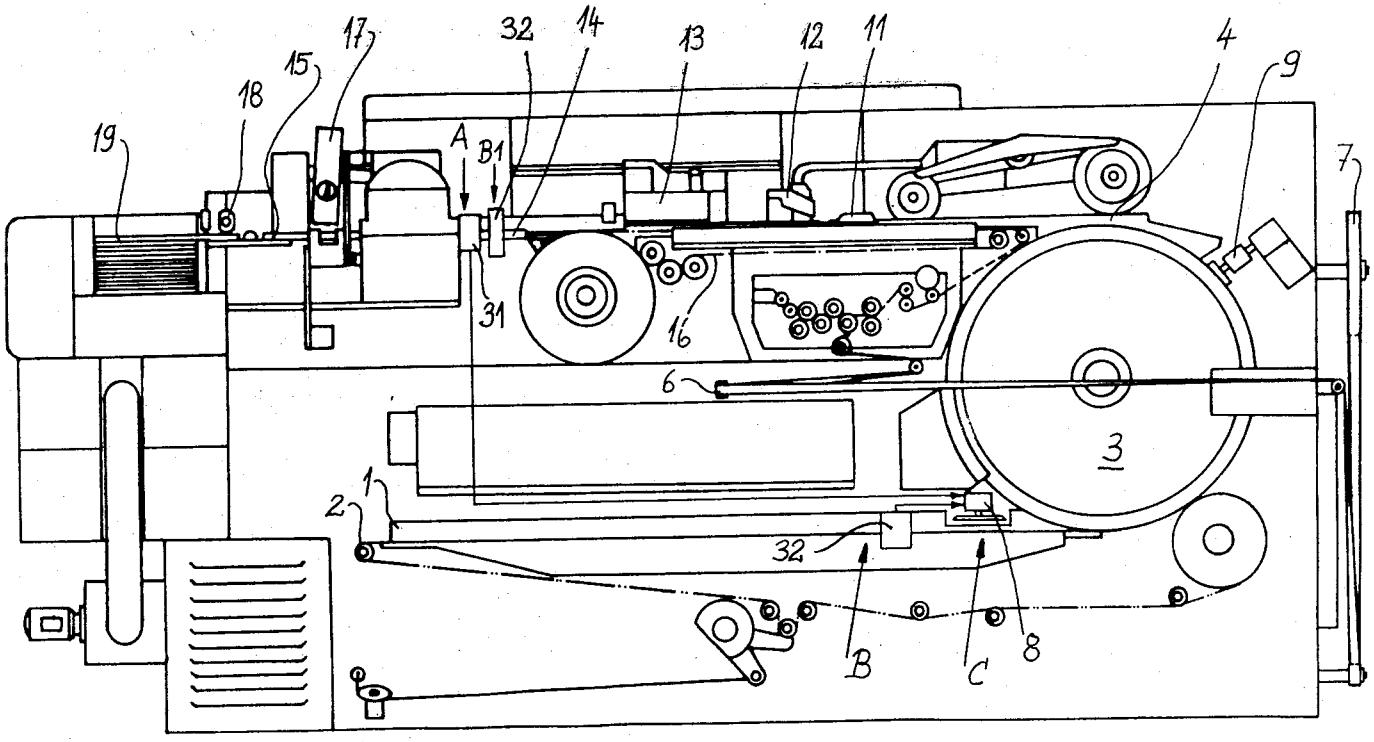
FIG. 1 schematically depicts a cigarette rod forming machine provided with a capacitive measuring arrangement according to the invention.

FIG. 1 depicts a cigarrette rod forming machine of the Garant type, manufactured by Hauni-Werke Koerber & Co. KG, in the art, with regard to both its construction and operation, and will accordingly be described only briefly, to establish the context of the invention.

A tobacco carpet, supported on a tobacco carpet conveying belt oriented normal to the plane of the drawing, is showered down into a tobacco channel 1 onto a moving tobacco conveyor belt 2, the tobacco being held upon the conveyor belt 2 by means of an applied suction force. The tobacco advances on the belt 2 towards a rotating conveyor disk 3, and enters into an annular conveying groove provided in the periphery of the disk 3. The tobacco is held in the conveying groove of disk 3 by suction applied from within the conveyor disk 3.

A transfer conveyor 4, essentially comprised of a conveyor belt and suction means for holding tobacco against the face of the belt, removes tobacco from the conveying groove of rotating conveying disk 3. The removed tobacco is held against the underside of the conveyor belt of transfer conveyor 4 by suction and is transferred onto a continuous web of cigarette paper 6, which is continuously pulled off a supply reel 7.

The tobacco in the stream travelling through the tobacco channel 1, until it reaches the point of transfer onto the cigarette paper 6, does not undergo any marked change in shape (ignoring the possiblity that excess tobacco in the stream will be removed during such travel), and constitutes a so-called tobacco filler stream or continuous tobacco filler body.

Located along the aforedescribed path of travel of the tobacco are two control arrangements which control the size of the tobacco stream. Each of these two control arrangements includes a respective one of the two trimmers 8 and 9. The trimmer 8 trims the stream as the latter leaves the tobacco channel 1, whereas the trimmer 9 trims the stream as the latter travels in the annular conveying groove of the rotating conveyor disk 3. The trimmers 8, 9 are essentially comprised of rotating circular cutting knives. The level of the cut effected by the rotating circular cutting knife is changed by shifting the cutting knife in the direction of its rotation axis. This shifting is controlled by separate positioning means, described more fully with respect to FIG. 4. This variation in the level of the cut makes it possible to remove more or less tobacco from the tobacco stream.

The continuous rod-like filler body is enclosed in the cigarette paper 6 by a wrapping mechanism 11, with the raised edge of the cigarette paper 6 being provided with a strip of gum or glue by means of a gumming or gluing device 12. A heating device 13 causes the gum or glue to dry, forming a gum or glue seam along the length of the cigarette paper 6. A finished continuous cigarette rod 14 moves off the belt 16 of the wrapping device, this belt also serving to pull the tobacco and the cigarette paper 6 through the wrapping device 11.

A rotating severing device 17 cuts through the continuous cigarette rod 14 at regular intervals to form individual cigarettes 15. The individual cigarettes 15 are caused to assume positions spaced from each other by means of an accelerator cam arrangement 18, and are transferred into the grooves of a row-forming conveyor drum 19, from which they are in turn conveyed for further processing.

In the region where the finished continuous cigarette rod 14 is formed, i.e., between the heating device 13 and the severing device 17, there is located a measuring station B1 provided with a capacitive density-measuring apparatus 32 according to the invention. The output of the density-measuring apparatus can be connected, inter alia, to the control arrangement 50 of the trimmer 8, for the purpose of adjusting the trimming action in dependence upon the detected density. For example, if the measured value of the density exceeds a predetermined value, the rotating circular cutting knife of the trimmer 8 can be brought closer to the tobacco stream, so as to remove tobacco from the continuous stream, or so as to increase the rate of removal of tobacco, in such a manner as to maintain the density of the tobacco stream substantially constant all along the length of the tobacco stream.

The capacitive density-measuring arrangement 32 of the invention can also be located at a measuring station B, in the vicinity of the tobacco channel 1. In that event, it can serve for detecting short-lasting fluctuations in the density of the unwrapped tobacco stream; e.g., the density-indicating output signal of the density-measuring arrangement 32 can be employed to control the cutting-knife position of the associated trimmer 8, located downstream of measuring station B. To monitor the operation of the arrangement which automatically controls the cutting-knife level of the trimmer 8, there is provided downstream of the cutting location in question, cutting location C, a further measuring station A provided with a so-called nuclear density-measuring arrangement 31 operating with beta rays. This arrangement is comprised of a body of radioactive material, for example strontium-90, which emits beta rays. Cooperating with the beta-ray emitter at measuring station A is a beta-ray detector operative for detecting the extent to which the beta rays are weakened in passing through the continuous cigarette rod 14. The beta-ray detector can have the form of an ionization chamber. A nuclear density-measuring arrangement of the type to be provided at measuring station A is disclosed, for example, in British Pat. No. 1,128,003.

Figure 2:
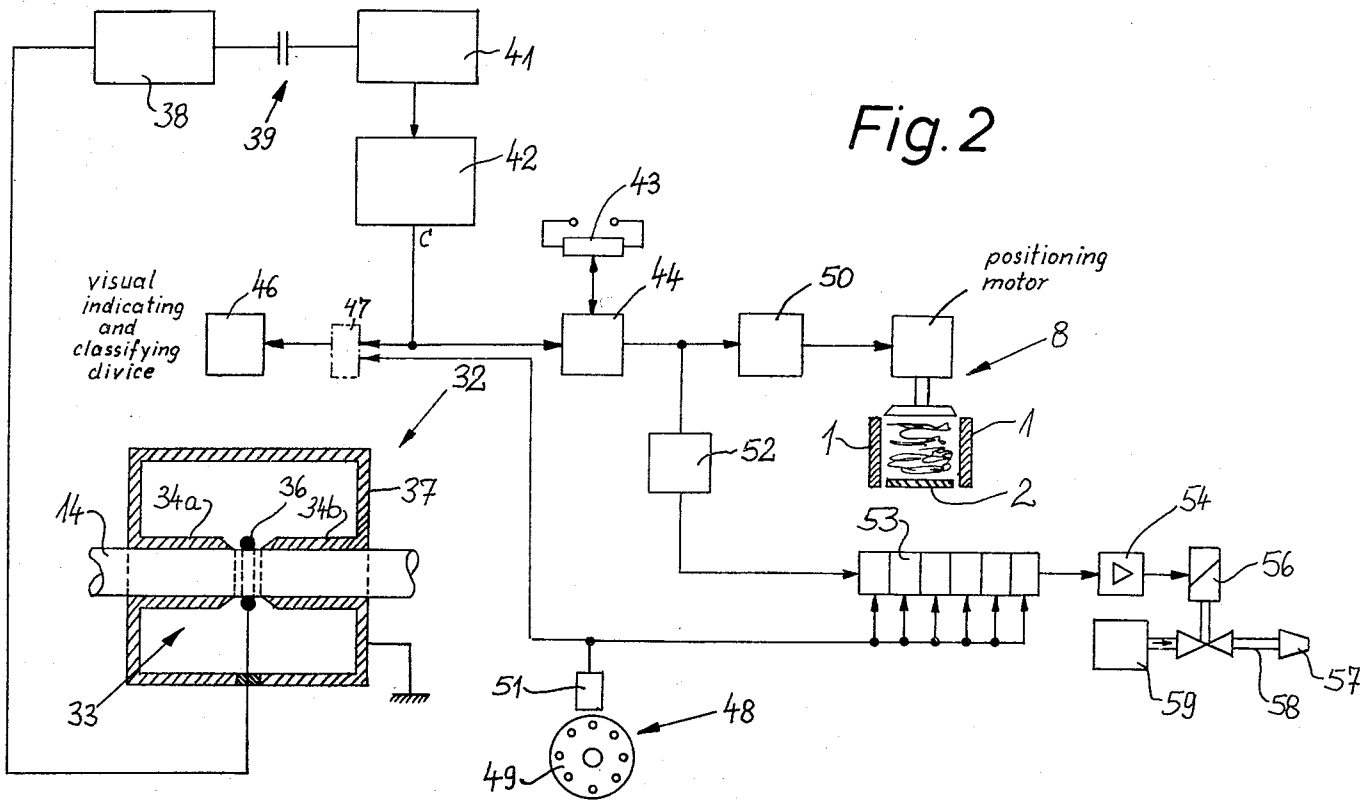
FIG. 2 depicts in block-diagram form the circuitry of the capacitive measuring arrangement and the structure of the mass-responsive capacitor of the arrangement.

FIG. 2 depicts, among other things, a measuring capacitor 33 operative for detecting the mass of tobacco in that portion of the continuous cigarette rod 14 which is located in the operative range of the measuring capacitor 33. The measuring capacitor 33 is comprised of two tubular electrodes 34*a*, 34*b* both of which are grounded, and is further comprised of a non-grounded annular electrode 36 disposed between and symmetrically with respect to the two electrodes 34*a*, 34*b*. The annular electrode 36 can be essentially a bent wire, and is connected to a high-frequency resonant circuit 38. The electrodes 34*a*, 34*b* are electrically connected with the grounded housing 37 of the capacitor arrangement, the housing 37 being mounted on a stationary portion of the cigarette rod forming machine shown in FIG. 1.

The measuring capacitor 33 forms part of the resonant-frequency-determining capacitance of the high-frequency resonant circuit 38. In the exemplary embodiment illustrated herein, the fundamental frequency of the resonant circuit 38 is 190 MHz. The resonant circuit 38, by means of a capacitor 39, is electrically connected to another high-frequency resonant circuit 41, constituting a reference oscillator having a constant frequency (in this example) of 200.7 MHz. The resonant circuits 38 and 41 are so dimensioned that their respective operating characteristics have substantially identical temperature dependencies, which in conventional manner can involve mounting the components of the two circuits on a common carrier or in a common housing in such a manner that all components of both circuits will always have substantially identical temperatures.

In the high-frequency reference resonant circuit 41, both oscillations—i.e., the first oscillation dependent in its frequency upon the mass of tobacco in the operative range of the capacitor 33, and the second constant-frequency oscillation—are superimposed. The resulting periodic output signal exhibits a beat; i.e. the amplitude of the envelope of the resulting high-frequency voltage changes periodically and with a certain frequency between a minimum value and a maximum value. This beat frequency, corresponding to the difference between the oscillation frequencies of the two high-frequency resonant circuits, is itself of a relatively low frequency, so that changes in this beat frequency can be detected relatively easily. The output voltage produced, with its relatively-low-frequency heat, is applied to a measuring stage 42 having in this embodiment the form of a ratio detector operative for generating an output signal whose magnitude is substantially proportional to the frequency of the beat of the input signal. This output signal is dependent upon the mass of tobacco in that portion of the continuous cigarette rod 14 which is located in the operative range of the capacitor structure 33. This output signal is compared, by a comparator or subtractor 44, against a desired-value signal furnished by a desired-value transducer 43, and the resulting difference or error signal can be employed to automatically control the spacing relative to tobacco conveyor 2 of the rotating cutter blade of trimmer 8, at cutting location C, in per se known servo-system fashion.

The tobacco-mass-indicating signal is furthermore applied to an indicating and classifying arrangement 46 in which the measured values of the tobacco mass are recorded and/or totalized, possibly subdivided into preselected ranges of values as explained further above.

It may be that only certain portions of the continuous cigarette rod 14 are of interest, for example those portions destined to constitute the locations at which the severing device 17 cuts a cigarette 15 off the continuous rod 14. If this is the case, then use can be made of an electronic gating device 47 which is enabled by gating signals furnished by a synchronizer 48. The synchronizer 48 can be comprised of a synchronizing disk 49 mechanically coupled to the drive motor of the machine of FIG. 1, or, more specifically, coupled to the drive mechanism of severing device 17 for operation synchronized therewith. The synchronizer disk 49 can be provided with apertures or markings detectable by a transducer 51 which generates the gating signals for the gating circuit 47. The distribution of apertures or markings on disk 49, and the rotation of disk 49 in synchronism with the rotating severing device 17, are such that a gating signal will be generated only at those moments when there is located at the measuring station a portion of the continuous cigarette rod 14 destined to be cut through by the severing device 17; as a consequence, tobacco-mass-indicating signals will be applied to the indicating and classifying stage 46 only at these moments.

The signal generated at the output of the subtractor 44, and indicative of the difference between the desired and actual values of the mass of tobacco per unit length of the tobacco stream, can be used not only to control the cutting level of the trimmer 8, but can furthermore be used to control the ejection of unacceptable cigarettes. Specifically, the signal at the output of subtractor 44 can be applied to a threshold circuit 52 (such as a Schmitt trigger the output of which is connected to the input of a dynamically triggered monostable multivibrator). This signal, indicative of the difference between the desired and actual values of the tobacco mass per unit length of the tobacco stream, triggers the threshold stage 52, when it exceeds a value preset for the threshold stage 52, thereby indicating that the just-mentioned difference between the desired and actual values has exceeded the permissible limit. When the threshold stage 52 is triggered in this manner, it applies a short-lasting pulse to the information-signal-input of a shift register 53. The shifting-signal-input of the shift register 53 receives shifting signals generated by the synchronizer 48, these shifting signals being synchronized with the operation of the machine of FIG. 1. Accordingly, the signal indicative of an unacceptable deviation of the actual tobacco mass value from the desired value travels from one shift-register stage to the next, in synchronism with and in simulation of the travel of the unacceptable section of the tobacco stream through the machine of FIG. 1. By the time the unacceptable-deviation signal reaches the last shift-register stage, the corresponding unacceptable section of the tobacco stream has become included within one of the individual cigarettes 15, and such individual cigarette 15 has reached a reject-ejection station. The unacceptable-deviation signal is applied from the output of the last shift-register stage, via an amplifier 54, to the control solenoid 56 of an electromagnetic valve connected in a pressure conduit 58. The conduit 58 is connected between a source 59 of pressurized air and a jet nozzle 57. The jet nozzle 57 is located at the just-mentioned reject-ejection station. Accordingly, when the unacceptable-deviation signal reaches the last shift-register stage, the solenoid 56 will be activated, opening the associated valve and causing a jet of air from nozzle 57 to eject that cigarette 15 which corresponds to the earlier-detected unacceptable tobacco stream portion out of the main path of travel, for example into a dumping bin for rejects.

Figure 3:
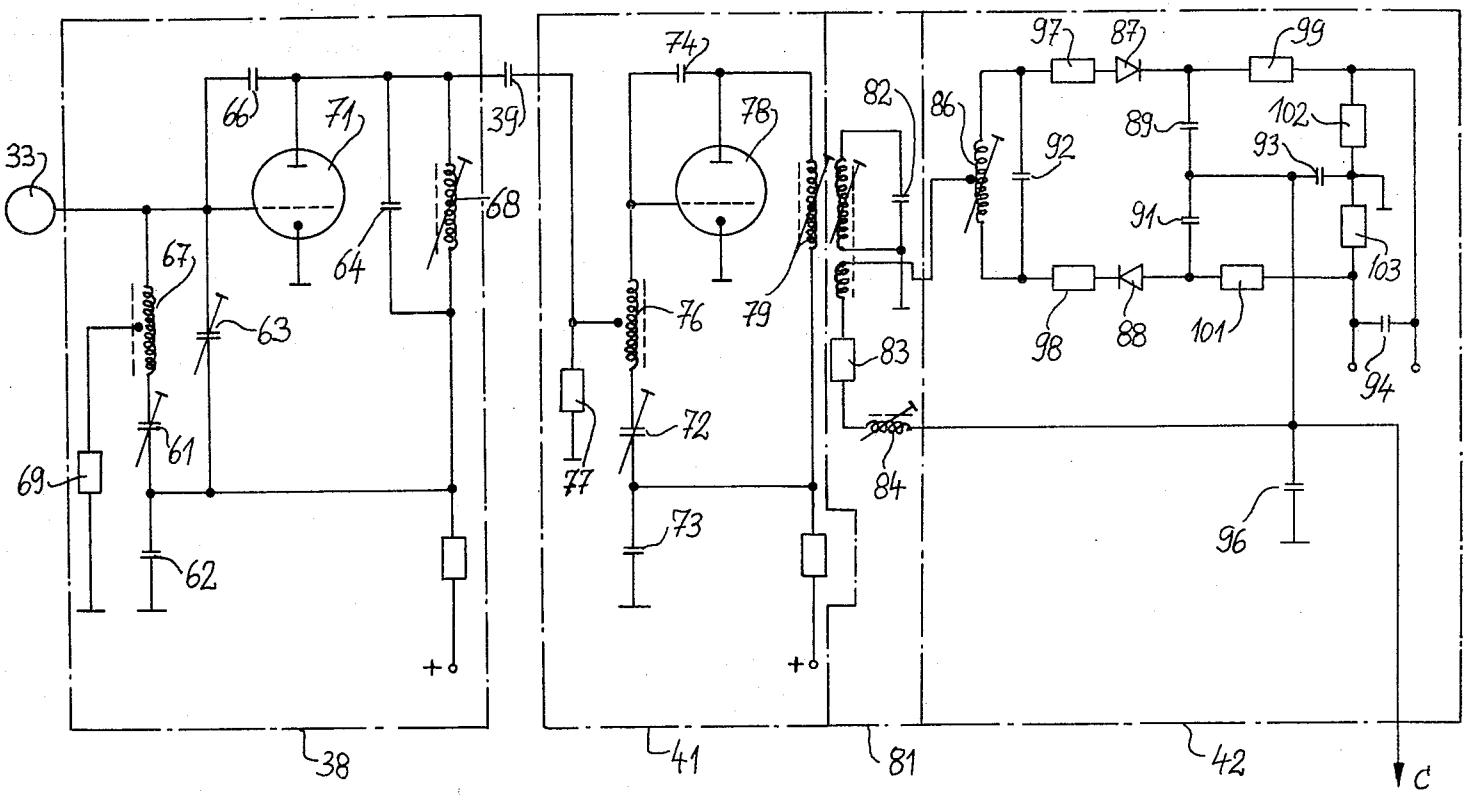
FIG. 3 shows details of the circuitry of FIG. 2.

FIG. 3 is a detailed circuit diagram of the high-frequency resonant circuits 38 and 41 and of the ratio rectifier 42.

The measuring capacitor 33 forms part of the frequency-determining reactance of the high-frequency variable-frequency resonant circuit 38, which additionally includes capacitors 61–64 and 66, inductors 67 and 68, a resistor 69 and a triode 71.

The high-frequency reference resonant circuit 41, operative for generating a fixed-frequency high-frequency reference A.C. voltage, is comprised of capacitors 72–74, a center-tapped inductor 76, a resistor 77 and a triode 78. By means of an inductive transformer 79, the beat voltage of 10.7 MHz, formed by superposition of the respective oscillations of resonant circuits 38 and 41, is transmitted to an intermediate stage 81 comprised of the secondary winding of the transformer 79, a capacitor 82, an ohmic resistor 83 and an inductive impedance 84. The intermediate stage 81 is operative for passing only voltage having the preselected beat frequency corresponding to the difference in frequency of the two resonant circuits 38, 41.

The ratio rectifier 42 is comprised essentially of an inductive input impedance in the form of a center-tapped winding 86, two diodes 87 and 88 arranged antiparallel, and charging capacitors 89 and 91. The ratio rectifier 42 additionally includes further capacitors 92–94 and 96 and ohmic resistors 97–99 and 101–103. The ratio rectifier 42, at its output c, furnishes a D.C. voltage having a magnitude dependent only upon the frequency of the beat voltage applied to the ratio rectifier, this frequency varying about a middle value of 10.7 MHz. Since this beat frequency is depedent upon the mass of tobacco in the continuous cigarette rod 14, the output signal furnished by circuit 42 constitutes a tobacco-mass-indicating signal.

In connection with the foregoing discussion of FIG. 3, it is noted that the circuit 38 has been referred to as a resonant circuit operative for generating a high-frequency signal having a tobacco-mass-dependent frequency, and that the circuit 41 has been referred to as a second resonant circuit operative for generating a fixed-frequency reference signal onto which the first high-frequency signal is superimposed. It should be noted that the circuit 41, if pulled out of context of the entire circuit shown in FIG. 3, does in fact perform as a fixed-frequency oscillator, and accordingly referring to it in the present disclosure as a fixed-frequency oscillator is appropriate and convenient. However, it should be understood that the circuit 41, in the context of the entire circuit shown in FIG. 3, does not separately generate a fixed-frequency oscillation onto which the tobacco-mass-dependent oscillation is superimposed; instead, it would be somewhat more accurate to say that, in the context of the entire circuitry of FIG. 3, the circuit 41 serves to modify the mass-dependent variable-frequency oscillation furnished by circuit 38 in a sense producing a resulting oscillation having a frequency which is on the same order of magnitude as, and preferably very close to, the tobacco-mass-dependent frequency, and which furthermore exhibits a beat whose frequency is considerably less than the tobacco-mass-dependent frequency, for example at least approximately one order of magnitude less than (one tenth) the tobacco-mass-dependent frequency. In view of the foregoing explanation, it should be clear why the frequency-modifying circuit 41 can be reasonably referred to as a fixed-frequency oscillator, although it does not generate a separately detectable fixed frequency signal; it should also be noted that the use of two oscillator generating signals which are actually separately detectable, one having a tobacco-mass-dependent frequency and the other having a fixed reference frequency, is within the scope of the present invention, since such a circuit would operate in substantially the same manner as the circuit of FIG. 3.

Figure 4:
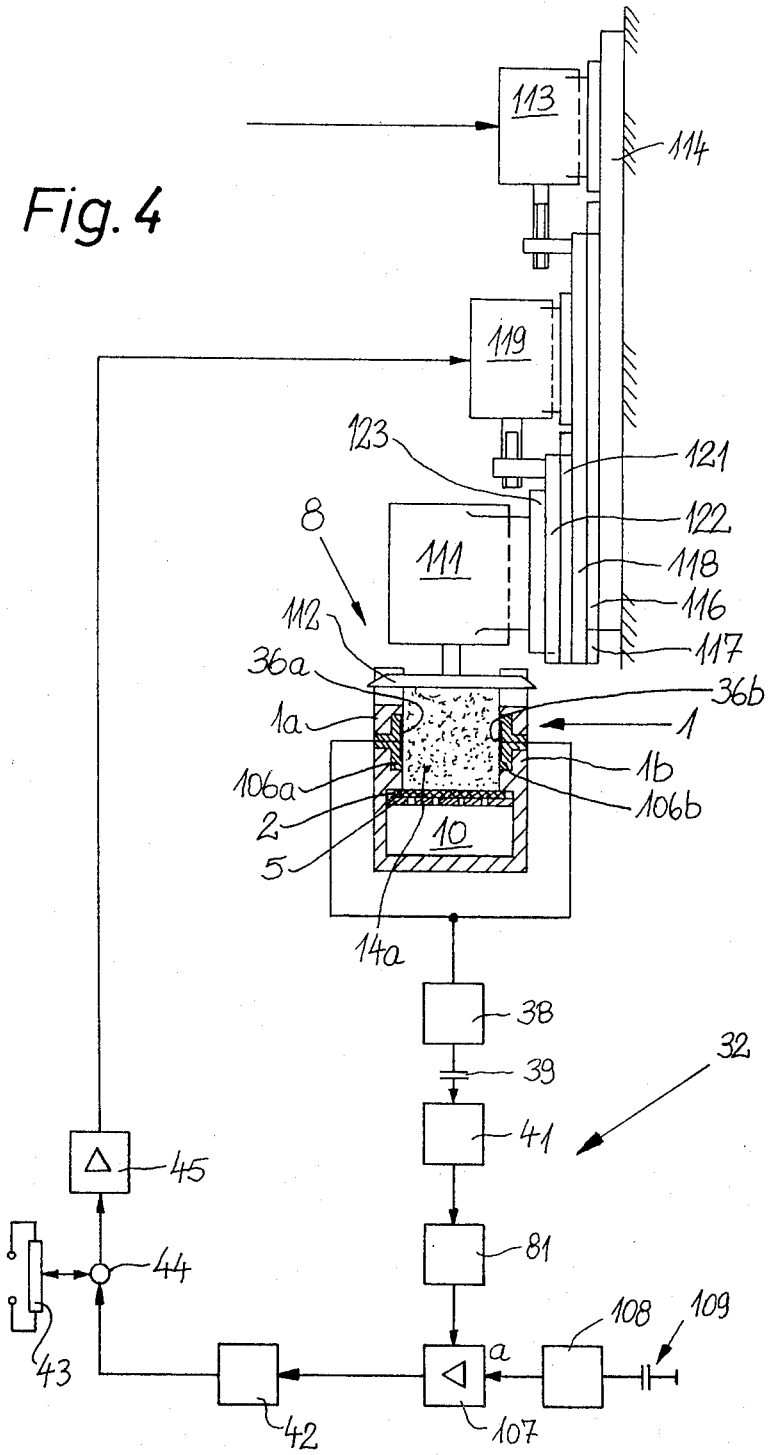
FIG. 4 depicts in block-diagram form the circuitry of another embodiment of the capacitive measuring arrangement and the structure of another embodiment of the mass-responsive capacitor of the arrangement.

The arrangement shown in FIG. 4 differs from that of FIG 2 in that the measuring capacitor can be so located as to measure the mass of tobacco per unit length of the tobacco stream 14*a* within the tobacco channel 1 itself, with a control signal being generated to make possible compensation for tobacco of different moisture content.

At the bottom of the tobacco channel 1, the air-permeable tobacco stream conveying belt 2 is guided for movement above and along the length of an elongated suction chamber 10 whose upper wall 5 is provided with a plurality of apertures through which suction force can be exerted.

Arranged in the side walls 1*a* and 1*b* of the tobacco channel 1 are two electrodes 36*a* and 36*b* insulated from the channel walls by respective insulating members 106*a*, 106*b* and electrically connected with the remaining circuit components of the high-frequency variable-frequency resonant circuit 38. For the counterelectrode (corresponding functionally to the counterelectrode structure 34*a*, 34*b* in FIG. 2), use is made of the channel walls 1*a*, 1*b* themselves.

The variable-frequency high-frequency resonant circuit 38, the capacitor 39, the fixed-frequency high-frequency resonant circuit 41, the intermediate stage 81 and the ratio rectifier 42 can be designed and connected together substantially as illustrated in FIG. 3. However, the circuit of FIG. 4 additionally includes, connected between the ratio rectifier 42 and the intermediate stage 81, a variable-gain high-frequency amplifier 107 provided with a gain-control-signal input a.

The gain-control signal is furnished by a high-frequency resonant compensation circuit 108, the frequency-determining reactance of which comprises a capacitor 109 having a tobacco-dependent capacitance. The resonant frequency of the high-frequency resonant compensation circuit 108 is chosen so high (in the gigahertz range) that the output signal of this circuit is dependent substantially exclusively upon the mositure content of the tobacco in the operative range of capacitor 109, while being substantially independent of the mass of such tobacco. The gain-control signal at the gain-control-signal input a of the variable-gain high frequency amplifier 107 accordingly compensates, at least in part, for the influence of moisture content variations upon the value of the tobacco-mass-indicating signal generated by the capacitive measuring arrangement 32 (comprised of circuit components 36*a*, 36*b*, 38, 39, 41, 81 and 42). The tobacco-mass-indicating output signal of the ratio rectifier 42 is applied to the subtractor 44, which also receives a desired-tobacco-mass-indicating signal, from desired-value transducer 43, as with the circuit of FIG. 2.

To effect the requisite shifting of the rotating circular cutting knife 112, driven by motor 111, and forming part of the first trimmer 8, there is provided a drive 113 mounted on a stationary base plate 114. A guideway 116 in the base plate 114 receives a guide rail 117 of a slidable plate 118; the plate 118 can be shifted vertically by the drive 113. Mounted on the slidable plate 118 is a drive 119. A guideway 121 of the slidable plate 118 receives a guide rail 122 of a further slidable plate 123; the plate 123 can be shifted vertically by the drive 119. Mounted on the slidable plate 123 is the motor 111 and the circular cutting knife 112.

The error signal furnished at the output of subtractor 44, indicative of the difference between the desired and actual values of the tobacco mass per unit length of the tobacco stream, is applied, via an amplifier 45, to the drive 119. The drive 119 causes the circular cutting knife to shift to a cutting level, relative to the tobacco stream conveyor belt 2, corresponding to the result of the measurement performed at measuring station B (FIG. 1), which is located upstream of cutting location C.

The drive 113 receives a control signal derived from the nuclear measuring device 31, which determines the density of the continuous cigarette rod 14 at the measuring location A (FIG. 1) downstream of the cutting location C, providing a very accurate measurement signal imparting long-term constancy to the regulating action of the apparatus. The short-lasting density fluctuations, which are detected by the capacitive measuring arrangement, are accordingly utilized for short-term regulation.

Whereas the foregoing discussion has involved the handling of tobacco, it will be understood that the scope of the invention includes the handling of other smokers' goods, such as filter rod material which is converted into a continuous filter rod and then cut into individual filter rod segments by a filter rod forming machine. Such a filter rod forming machine, as well as expedients for the control of the mass of the filter rod material, are disclosed, for example, in West German Offenlegunsschrift No. 2,017,360. In that publicaton, the control of the make-up of the filter rods is not effected by cutting off excess material, as with tobacco, but instead by changing the stretching of the material or its rate of feed.

Furthermore, whereas the foregoing discussion has involved the formation of cigarettes, it should be clear that the invention embraces the analogous formation of cigars, cigarillos and other smokers' products and analogous articles, as well as components thereof.

In particular, the invention is of great advantage in the use of a measuring capacitor having a form particularly successfully adapted for the applications intended, and in the manner in which the quantity to be measured is in fact measured, namely by detecting the frequency change in a variable-frequency high-frequency resonant circuit indirectly through the expedient of detecting a beat frequency derived from such circuit and from a fixed-frequency resonant circuit.

It will be understood that each of the elements described above, or two or more together, may also find a useful application in other types of circuits and constructions differing from the types described above.

While the invention has been illustrated and described as embodied in a cigarette rod forming machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it applications various applicaions without omitting features, that, from the standpoint of prior art, fairly constitute essential characteristics of the generic or specific aspects of this invention.

What is claimed as new and desired to be protected by Letters Patent is set forth in the appended claims:

1. In a machine operative for processing tobacco, filter material or other constituent material of smokers' products, or the like, of the type wherein a stream of such material moves along a predetermined path, an arrangement for detecting the mass of the material in such stream, comprising, in combination, first circuit means operative for generating a first periodic signal having a first frequency; second circuit means operative for generating a second periodic signal having a second frequency, at least one of said circuit means being comprised of a frequency-determining capacitor structure positioned in proximity to material moving along a predetermined portion of said path and so disposed as to have a capacitance value dependent upon the mass of material penetrated by electric field lines of said capacitor structure; signal combining means for combining said first and second periodic signals to form a resulting periodic signal exhibitig a beat; and measuring means operative for providing an indication of the mass of material penetrated by electric field lines of said capacitor structure by detecting the frequency of said beat.

2. An arrangement as defined in claim 1, wherein only said first circuit means is comprised of such a frequency-determining capacitor structure, and wherein said second circuit means is comprised of means operative for generating said second periodic signal with said second frequency independent of the mass of material in said stream.

3. An arrangement as defined in claim 1, wherein first and second circuit means are first and second high-frequency resonant circuits.

4. An arrangement as defined in claim 1, wherein said first and second frequencies are at least approximately one order of magnitude greater than the frequency of said beat.

5. An arrangement as defined in claim 1, wherein only said first circuit means is comprised of such a frequency-determining capacitor structure, and wherein said second circuit means is a fixed-frequency circuit.

6. An arrangement as defined in claim 1, wherein said measuring means comprises a ratio rectifier operative for generating a signal having a magnitude indicative of the frequency of said beat.

7. An arrangement as defined in claim 1, the capacitance value of said capacitor structure being dependent upon the moisture content of material penetrated by electric field lines of said capacitor structure, and further including compensating means operative for counteracting the effect upon said indication of such moisture content.

8. An arrangement as defined in claim 7, wherein said compensating means comprises means for generating a moisture-indicating signal indicative of the moisture content of the material in said stream, and means for varying a characteristic of said resulting signal in dependence upon said moisture-indicating signal.

9. An arrangement as defined in claim 7, wherein said compensating means comprises a variable-transfer-function circuit stage having an input connected to said combining means for receipt of said resulting signal and having an output connected to the input of said measuring means and having a transfer-function-control-signal input, and means for generating and applying to said transfer-function-control-signal input a moisture-indicating signal indicative of the moisture content of the material in said stream.

10. An arrangement as defined in claim 9, wherein said variable-transfer-function circuit stage is a variable-gain amplifier and wherein said transfer-function-control-signal input is a gain-control-signal input.

11. An arrangement as defined in claim 1, wherein said measuring means includes an indicator providing a visual indication corresponding to the frequency of said beat.

12. An arrangement as defined in claim 1, said machine being provided with a classifying arrangement, and wherein said measuring means comprises means operative for applying to said classifying arrangement a signal indicative of the frequency of said beat.

13. An arrangement as defined in claim 1, further including synchronizing means for correlating the indication provided by said measuring means with predetermined discrete portions of said stream.

14. An arrangement as defined in claim 1, wherein said measuring means comprises means providing said indication in the form of a detected-mass-indicating signal, and further including means for supplying a desired-mass-indicating signal and comparing means for comparing said detected-mass-indicating signal to said desired-mass-indicating signal to determine the extent of the discrepancy between the detected mass and the desired mass.

15. An arrangement as defined in claim 14, wherein said comparing means comprises means operative for generating a discrepancy-indicating signal indicative of the extent of said discrepancy.

16. An arrangement as defined in claim 15, and further including threshold circuit means connected to said comparing means for receiving said discrepancy-indicating signal and operative for generating a defect signal when the indicated discrepancy exceeds a preselected acceptable value.

17. An arrangement as defined in claim 16, the processing machine including means for converting said stream of material into a continuous rod and then into discrete rod segments and ejection means activatable for the ejection of rejects, and wherein said arrangement further includes activating means connected to said threshold circuit means for receipt of said defect signal and operative for activating the ejection means when the rod segment corresponding to the defect signal is at said ejection means.

18. An arrangement as defined in claim 14, the processing machine including mass-varying means controllable for varying the mass of material in said stream, and wherein said comparing means comprises means operative for generating and applying to said mass-varying means a control signal dependent upon the extent of said discrepancy for causing said mass-varying means to decrease said discrepancy.

19. An arrangement as defined in claim 18, the mass-varying means comprising a cutting knife mounted for shifting movement to remove from said stream a greater or lesser quantity of material and moving means controllable for effecting controlled shifting movement of the cutting knife, and wherein said means for applying a control signal comprises means for applying to said moving means a control signal dependent upon the extent of said discrepancy for causing said cutting knife to remove material from said stream to an extent causing said discrepancy to decrease.

20. An arrangement as defined in claim 18, and further including a nuclear measuring device operative for generating and applying to said mass-varying means an additional control signal dependent upon the extent of said discrepancy.

21. In a machine operative for processing tobacco, filter material or other constituent material of smokers' products, or the like, of the type wherein a stream of such material moves along a predetermined path, an arrangement for detecting the mass of the material in such stream, comprising a measuring capacitor structure comprising a plurality of electrode members spaced from each other in the direction of travel of the material along said path and each at least partially encircling said stream as considered in direction normal to the direction of travel of the material.

22. In a machine as defined in claim 21, wherein said electrode members encircle said stream extending around said stream by an angle greater than 180° considered in direction normal to the direction of travel of the material.

23. In a machine as defined in claim 22, wherein said electrode members completely encircle said stream.

24. In a machine as defined in claim 21, said plurality of electrode members including a central electrode member and two further electrode members, one upstream and the other downstream of said central electrode member, and further including means for maintaining said central electrode member at one potential and said two further electrode members at a common potential different from said one potential.

25. In a machine as defined in claim 24, wherein said means comprises a high-frequency A.C. voltage source having one terminal electrically connected to said central electrode member, and means connecting said two further electrode members to ground.

26. In a machine as defined in claim 24, wherein said central electrode member has the form of a wire at least partially encircling said stream and having no appreciable extension in the direction of movement of said stream, and wherein said two further electrode members each has appreciable extension in the direction of movement of said stream.

27. In a machine as defined in claim 21, said machine being of the type provided with means for converting an unwrapped stream of a constituent material of a smokers' product travelling along a portion of said path into an enclosed stream wrapped in a wrapping strip travelling along a further portion of said path, and wherein said electrodes surround said stream at a location along said further portion of said path.

28. In a machine as defined in claim 21, said machine being of the type provided with a guide conduit defining a portion of said path, said guide conduit having side boundary walls for confining the material of said stream within said conduit and between said boundary walls, and wherein said electrode members encircle a portion of said stream located between said boundary walls.

29. In a machine operative for processing tobacco, filter material or other constituent material of smokers' products, or the like, of the type wherein a stream of such material moves along a predetermined path, an arrangement for detecting the mass of the material in such stream, comprising, in combination, first circuit means operative for generating a first periodic signal, and including a frequency-determining capacitor structure positioned in proximity to material moving along a predetermined portion of said path and so disposed as to have a capacitance value dependent upon the mass of material penetrated by electric field lines of said capacitor structure; second circuit means operative for receiving said first periodic signal and modifying the same to form a resultant periodic signal having a frequency of the same order of magnitude as the frequency of said first periodic signal and exhibiting a beat having a frequency at least approximately one order of magnitude lower than the frequency of said first periodic signal; and measuring means operative for providing an indication of the mass of material penetrated by electric field lines of said capacitor structure by detecting the frequency of said beat.

* * * * *

UNITED STATES PATENT OFFICE
CERTIFICATE OF CORRECTION

Patent No. 3,996,942 Dated December 14, 1976

Inventor(s) Anton BAIER

It is certified that error appears in the above-identified patent and that said Letters Patent are hereby corrected as shown below:

Foremost page, left-hand column, item [73], "Korber & Co., KG," should read --Körber & Co. KG,--;
item [30], "13021/70" should read --13021/74--.
Col. 1, line 11, "smoker's" should read --smokers'--;
line 17, --high-frequency-- should be inserted before "resonant".
Col. 2, line 12, "usuable" should read --usable--;
line 20, "smoker's" should read --smokers'--.
Col. 3, line 14, "smoker's" should read --smokers'--.
Col. 4, line 67, "or" should read --of--.
Col. 5, line 52, "knive" should read --knife--;
line 62, "circiutry" should read --circuitry--.
Col. 6, line 22, --of Hamburg, West Germany. This machine is very well known-- should be inserted before "in".
Col. 8, line 39, "heat" should be changed to --beat--.
Col. 11, line 45, "mositure" should read --moisture--.
Col. 12, line 62, "appli-" should be deleted;
line 63, "cations" should be deleted, "applicaions" should be changed to --applications-- and the comma after "features" should be deleted;
line 68, the colon should be changed to a period.
Claim 3, line 1, --said-- should be inserted after "wherein".

Signed and Sealed this

Twelfth Day of April 1977

[SEAL]

*Attest:*

RUTH C. MASON
*Attesting Officer*

C. MARSHALL DANN
*Commissioner of Patents and Trademarks*